US006551965B2

(12) United States Patent
Nagamatsu et al.

(10) Patent No.: US 6,551,965 B2
(45) Date of Patent: Apr. 22, 2003

(54) MARINE DIESEL ENGINE LUBRICATING OIL COMPOSITION HAVING IMPROVED HIGH TEMPERATURE PERFORMANCE

(75) Inventors: Hiroyuki Nagamatsu, Gotenba (JP); Shigeru Iwamoto, Ogasa-Gun (JP); Hirokazu Fujita, Haibara-Gun (JP)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/001,500

(22) Filed: Nov. 14, 2001

(65) Prior Publication Data

US 2002/0123434 A1 Sep. 5, 2002

Related U.S. Application Data

(63) Continuation-in-part of application No. 09/780,294, filed on Feb. 9, 2001, now abandoned.

(30) Foreign Application Priority Data

Feb. 14, 2000 (JP) ..... 2000-034652

(51) Int. Cl.[7] ..... C10M 141/02; C10M 141/10

(52) U.S. Cl. ..... 508/192; 508/291; 508/391; 508/375; 508/378; 508/574

(58) Field of Search ..... 508/192, 291, 508/391, 375, 378, 574

(56) References Cited

U.S. PATENT DOCUMENTS

| | | | | | |
|---|---|---|---|---|---|
| 4,283,294 | A | * | 8/1981 | Clarke | 508/398 |
| 4,948,522 | A | | 8/1990 | Dunn et al. | 252/32.7 E |
| 5,262,073 | A | * | 11/1993 | Schmitt et al. | 508/294 |
| 5,312,554 | A | * | 5/1994 | Waddoups et al. | 508/398 |
| 5,328,620 | A | | 7/1994 | Ripple | 252/32.7 |
| 5,330,663 | A | * | 7/1994 | Wollenberg et al. | 508/399 |
| 5,356,552 | A | * | 10/1994 | Harrison et al. | 508/399 |
| 5,451,333 | A | | 9/1995 | Waddoups et al. | 252/50 |
| 5,569,405 | A | | 10/1996 | Nakazato et al. | 508/192 |
| 5,629,272 | A | * | 5/1997 | Nakazato et al. | 508/185 |
| 5,726,133 | A | * | 3/1998 | Blahey et al. | 508/390 |
| 5,780,398 | A | * | 7/1998 | King et al. | 508/401 |
| 6,103,672 | A | * | 8/2000 | Dunn et al. | 508/185 |

* cited by examiner

*Primary Examiner*—Jacqueline V. Howard
(74) *Attorney, Agent, or Firm*—S. G. K. Lee

(57) ABSTRACT

A lubricating oil composition containing a base oil of lubricating viscosity, overbased sulfurized alkylphenate detergent or its calcium salt, an overbased alkylsulfonate detergent or its calcium salt, an ashless dispersant, and a zinc dialkyldithiophosphate and/or zinc diaryidithiophosphate is described. The lubricating oil composition provides improved heat stability and anti-wear performance in marine diesel engines operated under severe conditions where the cylinder liner temperature may reach 200 to 260° C.

16 Claims, No Drawings

MARINE DIESEL ENGINE LUBRICATING OIL COMPOSITION HAVING IMPROVED HIGH TEMPERATURE PERFORMANCE

This application is a Continuation-in-Part of U.S. Ser. No. 09/780,294 filed Feb. 9, 2001, now abandoned, which claims priority from Japanese Patent Application Number 2000-034652, field Feb. 14, 2000.

The present invention relates to a lubricating oil composition for internal combustion engines, particularly two-stroke cross-head diesel engines such as marine engines. The lubricating oil composition of the present invention is highly effective under severe conditions in which cylinder liner temperatures may reach 200 to 260° C.

BACKGROUND OF THE INVENTION

For conventional two-stroke cross-head diesel internal combustion engines of large ships, a "marine cylinder lubricating oil" is used. Such lubricating oils usually contain various additives for improving durability and/or lubricating performance.

A typical lubricating oil for two-stroke cross-head diesel internal combustion engines of large ships comprises a lubricating base oil in which dissolved or dispersed are additives such as an overbased metal-containing detergent (e.g., calcium sulfonate, calcium phenate, calcium salicylate) and an ashless dispersant.

Metal-containing detergents help to neutralize acidic sulfur oxide (particularly sulfuric acid) that results from the burning of petroleum fuel such as fuel oil of grade C, which contains considerable amounts of sulfur (usually 1.0 to 4.0 wt %). Metal-containing detergents, along with ashless dispersants, also serve to disperse combustion residues, such as soot and sludge, which are produced as the fuel and the lubricating oil deteriorate and to prevent the residues from accumulating on the inner surface of the engine parts such as the pistons, piston grooves, and cylinder liner. While metal-containing detergents and ashless dispersants provide adequate heat stability and anti-wear performance under relatively moderate and high temperatures, their combination cannot give fully satisfactory performance under severe load conditions. In particular, in a two-stroke cross-head diesel engine having a large-caliber cylinder, the temperature at the top area of the cylinder liner wall (near the piston top ring groove) may rise up to 230 to 260° C., which is higher than the temperature in the conventional engine by 20% or more. Accordingly, if the lubricating oil has insufficient heat stability or gives poor anti-wear performance at such high temperatures, combustion residues produced by thermal deterioration of the lubricating oil accumulate on the top area of the piston or on the piston groove to cause wearing or scuffing on the cylinder liner.

Accordingly, there is a need for a lubricating oil composition having high heat stability and anti-wear performance at high temperatures to comply with the severe load conditions in marine two-stroke cross-head diesel engines.

SUMMARY OF THE INVENTION

The present invention relates to a lubricating oil composition for internal combustion engines, particularly two-stroke cross-head diesel engines such as marine diesel engines. The lubricating oil composition of the present invention is useful in a method of improving the heat stability and anti-wear performance of marine diesel engines operated under severe conditions where cylinder liner temperatures may reach 200 to 260° C.

In its broadest aspect, the present invention comprises a lubricating oil composition having a TBN (in terms of mg KOH/g) in the range of 40 to 100, preferably 50 to 90, and having a major amount of a base oil of lubricating viscosity having a kinematic viscosity of 22 to 300 $mm^2/s$ at 40° C., overbased sulfurized alkylphenate detergent or its calcium salt, an overbased alkylsulfonate detergent or its calcium salt, an ashless dispersant, and a zinc dialkyldithiophosphate and/or zinc diaryldithiophosphate, wherein the weight ratio between the overbased sulfurized alkylphenate detergent or its calcium salt and the overbased alkylsulfonate detergent or its calcium salt is in the range of 55:45 to 95:5.

In another aspect, the present invention relates to a lubricating oil additive concentrate containing a compatible organic diluent, overbased sulfurized alkylphenate detergent or its calcium salt, an overbased alkylsulfonate detergent or its calcium salt, an ashless dispersant, and a zinc dialkyldithiophosphate and/or zinc diaryidithiophosphate, wherein the weight ratio between the overbased sulfurized alkylphenate detergent or its calcium salt and the overbased alkylsulfonate detergent or its calcium salt is in the range of 55:45 to 95:5.

In a further aspect, the present invention relates to a method of improving the heat stability and anti-wear performance at high temperatures of an internal combustion engine, particularly a two-stroke cross-head diesel engine, by lubricating the engine with the lubricating oil composition of the present invention.

In still a further aspect, the present invention relates to a method of producing the lubricating oil composition of the present invention by blending a mixture of the components of the lubricating oil composition of the present invention. The resulting lubricating oil composition having improved heat stability and anti-wear performance at high temperatures in an internal combustion engine.

Among other factors, the present invention relates to the use of an overbased sulfurized alkylphenate detergent or its calcium salt, an overbased alkylsulfonate detergent or its calcium salt, an ashless dispersant and a zinc dialkyldithiophosphate and/or of a zinc diaryldithiophosphate for improving the heat stability and anti-wear performance at high temperatures of a lubricating oil composition for two-stroke cross-head diesel engines comprising a major amount of a base oil of lubricating viscosity and an effective amount of an overbased sulfurized alkylphenate detergent or its calcium salt, an overbased alkylsulfonate detergent or its calcium salt, an ashless dispersant and a zinc dialkyldithiophosphate and/or of a zinc diaryldithiophosphate, wherein the weight ratio between the overbased sulfurized alkylphenate detergent or its calcium salt and the overbased alkylsulfonate detergent or its calcium salt is in the range of 55:45 to 95:5.

DETAILED DESCRIPTION OF THE INVENTION

In its broadest aspect, the present invention involves a lubricating oil composition for internal combustion engines, particularly two-stroke cross-head diesel engines such as marine diesel engines, having improved heat stability and anti-wear performance.

The base oil of lubricating viscosity used in the lubricating oil composition of the present invention may be a mineral or a synthetic base oil having a kinematic viscosity of 22 to 300 $mm^2/s$, preferably 22 to 140 $mm^2/s$ at 40° C. Mineral oil employable for the invention can be obtained from crude oil by distillation (under atmospheric or reduced pressure) and purification such as solvent extraction, hydrogenolysis, solvent dewaxing or hydrogenation refining. Mineral oils for use as the base oil in this invention include, for example, paraffinic, naphthenic and other oils that are ordinarily used in lubricating oil compositions.

Synthetic oils include, for example, both hydrocarbon synthetic oils and synthetic esters and mixtures thereof having desired viscosity. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful. The overbased sulfurized alkylphenate detergent of the present invention is a metal salt of sulfurized alkylphenol having an alkyl group of about 8 to 30 carbon atoms. It may be incorporated in an amount of 5.0 to 35.0 wt %, preferably 20 to 30 wt %, based on the total amount of the lubricating oil composition. The wt % includes a small amount of remaining hydrocarbon oil used in the preparation of the overbased sulfurized alkylphenate detergent. The overbased sulfurized alkylphenate detergent may also be a salt of an alkali or alkaline earth metal with a sulfurized alkylphenol having an alkyl group of about 8 to 30 carbon atoms. Examples of the salts include lithium salt, sodium salt, calcium salt, magnesium salt and barium salt. Calcium salt is preferred. In the case where a calcium salt of the overbased sulfurized alkyl phenate is used as the detergent, the calcium salt of the overbased sulfurized alkylphenate may be incorporated in an amount of 0.4 to 4.0 wt %, preferably 1.6 to 3.5 wt %, based on its calcium content. The overbased sulfurized alkylphenate or its calcium salt has a Total Base Number (TBN, defined by JIS-K 2501, in terms of mg KOH/g) greater than 200, preferably greater than 250.

If the overbased sulfurized alkylphenate detergent is present in the lubricating oil composition in an amount of less than 5.0 wt %, the lubricating oil composition will not have enough heat-stability at high temperatures to prevent thermal deterioration. On the other hand, even if the detergent is incorporated in an amount of more than 35.0 wt %, the effect corresponding to the increased amount of overbased sulfurized alkylphenate detergent is not brought about and the excess detergent is wasted.

The overbased alkylsulfonate detergent of the present invention is a sulfonate of mineral oil having a molecular weight of about 400 to 6,000 or a sulfonate of an aromatic compound having an alkyl group of about 8 to 30 carbon atoms. It may be incorporated in an amount of 2.5 to 20.0 wt %, preferably 5.0 to 11.25 wt %, based on the total amount of the lubricating oil composition. The wt % includes a small amount of remaining hydrocarbon oil used in the preparation of the overbased alkylsulfonate. The overbased alkylsulfonate detergent may also be a salt of an alkali or alkaline earth metal with a sulfonate of mineral oil having a molecular weight of about 400 to 6,000 or a sulfonate of an aromatic compound having an alkyl group of about 8 to 30 carbon atoms. Examples of the salts include lithium salt, sodium salt, calcium salt, magnesium salt and barium salt. Calcium salt is preferred. In the case where the overbased calcium alkylbenzenesulfonate is used as the detergent, the calcium salt of the overbased alkylsulfonate may be incorporated in an amount of 0.3 to 5.0 wt %, preferably 0.6 to 2.8 wt %, based on its calcium content. For example, a known overbased alkyloxybenzenesulfonate is employable. The overbased alkylsulfonate or its calcium salt has a Total Base Number (TBN, defined by JIS-K 2501, in terms of mg KOH/g) greater than 200, preferably greater than 250, more preferably greater than 350, and most preferably greater than 450.

If the overbased alkylsulfonate detergent is present in the lubricating oil composition in an amount of less than 2.5 wt %, the lubricating oil composition will not have enough heat-stability at high temperatures to prevent thermal deterioration. On the other hand, even if the detergent is incorporated in an amount of more than 20.0 wt %, the effect corresponding to the increased amount of overbased alkylsulfonate detergent is not brought about and the excess detergent is wasted.

The weight ratio between the overbased sulfurized alkylphenate detergent and the overbased alkylsulfonate detergent must be in the range of 55:45 to 95:5 (former: latter), and is preferably 60:40 to 90:10.

In the lubricating oil composition of the present invention, an ashless dispersant is incorporated in an amount of 0.1 to 3.0 wt %, preferably 0.5 to 1.5 wt %, based on the total amount of the composition. In the dispersant, a hydrocarbon oil having been used in preparing the dispersant remains in a small amount, and therefore the above values include the amount of the remaining hydrocarbon oil.

Examples of the ashless dispersants include succinimide, succinic ester, benzylamine and their modified compounds with organic acid, inorganic acid, alcohol or ester. In the case that a succinimide is employed as the dispersant, the above-mentioned range corresponds to 0.001 to 0.1 wt %, preferably 0.005 to 0.05 wt %, in terms of nitrogen content. A preferred ashless dispersant in the present invention is a polyalkylene succinimide.

Polyalkylene succinimides are disclosed in numerous references and are well known in the art. Certain fundamental types of succinimides and the related materials encompassed by the term of art "succinimide" are described in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl- or alkyl-substituted succinic acid or anhydride with a nitrogen-containing compound such as a polyalkylene polyamine. The succinimide dispersant is, for example, prepared by a reaction between maleic anhydride and a polybutene having an average molecular weight of about 800 to 8,000 or a chlorinated polybutene having an average molecular weight of about 800 to 8,000 at 100 to 200° C. to give a polybutenylsuccinic acid anhydride, and causing the obtained anhydride to react with a polyamine. Examples of the polyamines include ethylenediamine, diethylenetriamine, triethylenetetramine, tetraethylenepentamine, pentaethylenehexamine, and hexaethyleneheptamine.

The polyalkylene succinimides of the present invention can be prepared by conventional processes, such as disclosed in U.S. Pat. Nos. 2,992,708; 3,018,250; 3,018,291; 3,024,237; 3,100,673; 3,172,892; 3,219,666; 3,272,746; 3,361,673; 3,381,022; 3,912,764; 4,234,435; 4,612,132; 4,747,965; 5,112,507; 5,241,003; 5,266,186; 5,286,799;

5,319,030; 5,334,321; 5,356,552; 5,716,912, the disclosures of which are all hereby incorporated by reference in their entirety for all purposes.

The succinimide dispersant of the present invention preferably is a borated succinimide, and the preferred borated dispersant can be prepared, for example, by a reaction between the aforementioned succinimide and a boric acid or boric acid derivative.

If the ashless dispersant is present in the lubricating oil composition in an amount of less than 0.1 wt %, the composition will not show enough sludge dispersing power. Further, if water is present, that composition exhibits poor stability. On the other hand, if the dispersant is incorporated in an amount of more than 3.0 wt %, the composition is liable to have poor heat-stability.

In the lubricating oil composition of the present invention, a zinc dialkyldithiophosphate and/or a zinc diaryldithiophosphate (Zn-DTP) is further incorporated in an amount of 0.1 to 4.0 wt %, more preferably 0.1 to 2.0 wt %, and most preferably 0.1 to 1.5 wt %, based on the total amount of the composition. In Zn-DTP, a hydrocarbon oil having been used in preparing the compound remains in a small amount, and hence the above values include the amount of the remaining hydrocarbon oil. The above-mentioned range corresponds to 0.0075 to 0.3 wt %, more preferably 0.0075 to 0.2 wt %, and most preferably 0.0075 to 0.11 wt %, in terms of phosphorus content.

The alkyl group in the zinc dialkyldithiophosphate is, for example, a straight or branched primary, secondary or tertiary alkyl group of about 2 to 18 carbon atoms. Examples of the alkyl groups include ethyl, propyl, iso-propyl, butyl, pentyl, hexyl, heptyl, octyl, decyl, dodecyl, and octadecyl. As the zinc diaryldithiophosphate, a zinc dialkylaryidithiophosphate is preferred. The alkylaryl group of the zinc dialkylaryldithiophosphate is, for example, a phenyl group having an alkyl group of about 2 to 18 carbon atoms, such as butylphenyl group, nonylphenyl group, and dodecylphenyl group.

If the zinc dialkyldithiophosphate and/or zinc diaryidithiophosphate is present in the lubricating oil composition in an amount of less than 0.1 wt %, the lubricating oil composition will not show satisfactory anti-oxidation stability. On the other hand, even if the compound is incorporated in an amount of more than 4.0 wt %, the effect corresponding to the increased amount is not brought about.

The lubricating oil composition of the present invention is useful in a method of improving the high temperature heat stability and anti-wear performance of internal combustion engines, particularly two-stroke cross-head diesel engines. In that method, the lubricating oil composition of the present invention is used to lubricate an internal combustion engine.

The lubricating oil composition of the present invention can be prepared by successively or simultaneously adding the additive components to a base oil of lubricating viscosity, or by beforehand preparing a lubricating oil additive concentrate, as herein described below, and then mixing it with a base oil of lubricating viscosity.

In a further embodiment, the lubricating oil composition of the present invention is produced by blending a mixture of the above components. The lubricating oil composition produced by that method might have a slightly different composition than the initial mixture, because the components may interact. The components can be blended in any order and can be blended as combinations of components.

The lubricating oil additive concentrate of the present invention usually includes the product produced by blending:

a) 1.0 to 50.0 wt % of a compatible organic diluent, b) 5.0 to 90.0 wt % of an overbased sulfurized alkylphenate detergent, c) 5.0 to 90.0 wt % of an overbased alkylsulfonate detergent, d) 0.5 to 50.0 wt % of an ashless dispersant, e) 0.5 to 20 wt % of a zinc dialkyldithiophosphate or of a zinc diaryidithiophosphate, wherein the weight ratio between the overbased sulfurized alkylphenate detergent and the overbased alkylsulfonate detergent is in the range of 55:45 to 95:5.

The lubricating oil additive concentrate of the present invention may also include the product produced by blending:

a) 1.0 to 50.0 wt % of a compatible organic diluent, b) 0.4 to 9.0 wt %, based on its calcium content, of an overbased sulfurized alkylphenate detergent, c) 0.6 to 16.0 wt %, based on its calcium content, of an overbased alkylbenzenesulfonate detergent, d) 0.005 to 1.0 wt %, based on its nitrogen content, of a nitrogen-containing ashless dispersant, e) 0.005 to 1.5 wt %, based on its phosphorus content, of a zinc dialkyldithiophosphate or of a zinc diaryldithiophosphate, wherein the weight ratio between the overbased sulfurized alkylphenate detergent and the overbased alkylsulfonate detergent is in the range of 55:45 to 95:5.

The concentrates contain sufficient organic liquid diluent to make them easy to handle during shipping and storage. Typically, the concentrate will contain from 1.0 to 50.0 wt %, preferably 3.0 to 20.0 wt %, more preferably 5.0 to 10.0 wt %, of a compatible organic diluent.

Suitable compatible organic diluents which can be used include, for example, solvent refined 100N, i.e., Cit-Con 100N, and hydrotreated 100N, i.e., Chevron 100N, and the like. The organic diluent preferably has a viscosity of about from 1.0 to 20.0 cSt at 100° C.

The components of the lubricating oil additive concentrate can be blended in any order and can be blended as combinations of components. The concentrate produced by blending the above components might be a slightly different composition than the initial mixture because the components may interact.

Other Additives

The following additive components are examples of some of the components that can be favorably employed in the present invention. These examples of additives are provided to illustrate the present invention, but they are not intended to limit it.

Examples of the auxiliary additives include extreme pressure agents, corrosion inhibitors, rust inhibitors, friction modifiers, anti-foaming agents, viscosity index improvers and pour point depressants. Also employable are anti-wear agents and multi-functional additives (e.g., an organic molybdenum compound such as molybdenum dithiophosphate). As the viscosity improver, polyalkyl methacrylate, ethylene-propylene copolymer, styrene-butadiene copolymer, or polyisobutylene is generally employed. Otherwise, a dispersion-type or multi-functional viscosity index improver can be employed. The viscosity index improver can be used singly or in combination of various types. The amount of a viscosity index improver in the lubricating oil can vary depending upon the viscosity desired for the target engine oil.

EXAMPLES

The invention will be further illustrated by the following examples, which set forth particularly advantageous embodiments. While the Examples are provided to illustrate the present invention, they are not intended to limit it. This application is intended to cover those various changes and substitutions that may be made by those skilled in the art without departing from the spirit and scope of the appended claims.

Examples 1–6

Cylinder lubricating oil compositions for marine diesel engine [SAE viscosity grade: 50, Total Base Number (TBN measured by D2896): 70] were prepared using the following components.

(1) overbased sulfurized alkylphenate detergent
calcium phenate having TBN of 255 [Ca content: 9.25 wt %]

(2) overbased alkylbenzenesulfonate detergent
(2A) calcium sulfonate having TBN of 400 [Ca content: 16.0 wt %]
(2B) calcium sulfonate having TBN of 490 [Ca content: 18.6 wt %]

(3) ashless dispersant
(3A) succinimide [N content: 1.75 wt %]
(3B) borated succinimide [N content: 1.5 wt %, B content: 0.5 wt %]

(4) zinc dialkyldithiohosphate and/or zinc diaryidithiophosphate (Zn-DTP)
(4A) zinc dithiophosphate, primary alkyl type [P content: 7.4 wt %]
(4B) zinc didodecylphenyldithiophosphate [P content: 2.85 wt %]

Comparative Examples A–D

Cylinder lubricating oil compositions for marine diesel engine [SAE viscosity grade: 50, Total Base Number (TBN measured by D2896): 70] were prepared using the above-mentioned components.

Comparative Examples E–F

Commercially available lubricating oil compositions for marine diesel engine [SAE viscosity grade: 50, Total Base Number (TBN measured by D2896): 70] were obtained.

The components and the amounts thereof used for preparing each Example are set forth in Table 1. The concentration of ashless dispersants (3A and 3B) and zinc dithiophosphates (4A and 4B) was shown in terms of wt %. As to metallic detergents, the weight ratio between calcium phenate (1) and calcium sulfonate (2A or 2B) was shown, in total 100, wherein a total weight of the detergents was adjusted to yield a TBN of 70. The base oil (Viscosity: 263 $mm^2/s$ at 40° C., Viscosity Index: 95) for SAE50, used in Table 1, is a mixture of solvent-refined 500N and 150 bright stock.

Performance Evaluation

The lubricating performance of each composition was evaluated by the following tests, and the results are set forth in Table 1.

1) Hot Tube Test

The merit of each composition after the test at 330° C. for 16 hours was evaluated (the value of a clean sample is set at 10).

2) Falex Test at High Temperature (Measuring Loss by Wear in Weight (mg) of a Pin at 220° C.)

Conditions:
i) Temperature: 220° C.,
ii) Load: 900 lb (408 kg), and
iii) Time Period: 30 minutes

TABLE 1

| Components | 1 | 2 | 3 | 4 | 5 | 6 | A | B | C | D | E | F |
|---|---|---|---|---|---|---|---|---|---|---|---|---|
| | | | | | Weight Ratio for Phenate and Sulfonate | | | | | | | |
| 1 | 83 | 83 | 83 | 62 | 83 | 83 | 10 | 83 | 62 | 35 | Commercially | |
| 2A | 17 | 17 | 17 | 38 | — | 17 | 90 | 17 | 38 | 65 | available | |
| 2B | — | — | — | — | 17 | — | — | — | — | — | product | |
| | | | | | Weight, % | | | | | | | |
| 3A | 0.8 | 0.8 | — | 0.8 | 0.8 | 0.8 | — | — | — | — | | |
| 3B | — | — | 2 | — | — | — | 1.92 | — | — | — | | |
| 4A | 0.25 | 0.25 | 0.25 | 0.25 | 0.25 | — | 0.25 | — | — | — | | |
| 4B | — | — | — | — | — | 0.25 | — | — | — | — | | |
| SAE/TBN | 50/70 | 50/70 | 50/70 | 50/70 | 50/70 | 50/70 | 50/70 | 50/70 | 50/70 | 50/70 | 50/70 | 50/70 |
| Hot tube test | 7.0 | 7.0 | 7.0 | 7.0 | 6.5 | 7.0 | Blocked | 7.0 | 6.5 | Blocked | 7.0 | Blocked |
| Falex test @ 220° C. | 1.8 | 2.4 | 2.8 | 2.6 | 7.5 | 16.1 | 50.1 | 1000 | 1000 | 1000 | 113.0 | 1000 |

The data presented in Table 1 indicate that the lubricating oil compositions of the present invention (Examples 1–6) exhibit such excellent heat-stability in the hot tube test that they produce little lubricating oil oxidation or degradation product to defile the tube. Also, the results in Table 1 indicate that the lubricating oil compositions of the present invention cause very little wear in the Falex test at high temperature. On the other hand, Comparative Examples A–F cause severe wear in the Falex test at high temperature. Further, Comparative Examples A and D, where the wt % of overbased calcium sulfonate is greater than the wt % of the calcium phenate, caused the tube to be blocked in the hot tube test due to heavy oxidation. This suggests that the lubricating oil oxidation products may be liable to block the pistons of a marine diesel engine if the composition of Comparative A or B is used under very severe conditions.

What is claimed is:

1. A marine diesel engine lubricating oil composition having a TBN in the range of 40 to 100 and comprising:

a) a major amount of a base oil of lubricating viscosity having a kinematic viscosity of 22 to 300 $mm^2/s$ at 40° C., b) 5.0 to 35.0 wt % of an overbased sulfurized alkylphenate detergent, c) 2.5 to 20.0 wt % of an overbased alkylsulfonate detergent, d) 0.1 to 3.0 wt % of an ashless dispersant, and e) 0.1 to 4.0 wt % of a zinc dialkyldithiophosphate or of a zinc diaryldithiophosphate, wherein the weight ratio between the overbased sulfurized alkylphenate detergent and the overbased alkylsulfonate detergent is in the range of 55:45 to 95:5.

2. The marine diesel engine lubricating oil composition according to claim 1, wherein the weight ratio between the overbased sulfurized alkylphenate detergent and the overbased alkylsulfonate detergent is in the range of 60:40 to 90:10.

3. The marine diesel engine lubricating oil composition according to claim 1, wherein the overbased sulfurized alkylphenate detergent has a TBN greater than 200.

4. The marine diesel engine lubricating oil composition according to claim 1, wherein the overbased alkylsulfonate detergent has a TBN greater than 250.

5. The marine diesel engine lubricating oil composition according to claim 1, wherein the ashless dispersant is a succinimide with a polybutenyl group having a molecular weight of 800 to 8,000.

6. The marine diesel engine lubricating oil composition according to claim 5, wherein the ashless dispersant is a borated succinimide.

7. A marine diesel engine lubricating oil composition having a TBN in the range of 40 to 100 and comprising:

a) a major amount of a base oil of lubricating viscosity having a kinematic viscosity of 22 to 300 $mm^2/s$ at 40° C., b) 0.4 to 4.0 wt %, based on its calcium content, of an overbased sulfurized calcium alkylphenate detergent, c) 0.3 to 5.0 wt %, based on its calcium content, of an overbased calcium alkylbenzenesulfonate detergent, d) 0.001 to 0.1 wt %, based on its nitrogen content, of a nitrogen-containing ashless dispersant, and e) 0.0075 to 0.3 wt %, based on its phosphorus content, of a zinc dialkyldithiophosphate or of a zinc diaryldithiophosphate, wherein the weight ratio between the overbased sulfurized calcium alkylphenate detergent and the overbased calcium alkylbenzenesulfonate detergent is in the range of 55:45 to 95:5.

8. The marine diesel engine lubricating oil composition according to claim 7, wherein the weight ratio between the overbased sulfurized alkylphenate detergent and the overbased alkylsulfonate detergent is in the range of 60:40 to 90:10.

9. The marine diesel engine lubricating oil composition according to claim 7, wherein the overbased sulfurized calcium alkylphenate detergent has a TBN greater than 110.

10. The marine diesel engine lubricating oil composition according to claim 7, wherein the overbased calcium alkylbenzenesulfonate detergent has a TBN greater than 120.

11. The marine diesel engine lubricating oil composition according to claim 7, wherein the nitrogen-containing ashless dispersant is a succinimide with a polybutenyl group having a molecular weight of 800 to 8,000.

12. The marine diesel engine lubricating oil composition according to claim 11, wherein the ashless dispersant is a borated succinimide.

13. A method of improving the heat stability and anti-wear performance at high temperatures of a marine diesel internal combustion engine, said method comprising lubricating the internal combustion engine with a marine diesel engine lubricating oil composition according to claim 1.

14. A method of improving the heat stability and anti-wear performance at high temperatures of an internal combustion engine according to claim 13, wherein the internal combustion engine is a two-stroke cross-head marine diesel engine.

15. A method for producing a marine diesel engine lubricating oil composition comprising blending the components according to claim 1.

16. A marine diesel engine lubricating oil composition produced by the method according to claim 15.

* * * * *